United States Patent [19]

Gähler

[11] Patent Number: 5,005,630

[45] Date of Patent: Apr. 9, 1991

[54] PROCESS FOR PRODUCING FOUNDRY MOLDS AND CORES FROM SAND AND A BINDER

[76] Inventor: Franz Gähler, Hub, 9534, Gähwil, Switzerland

[21] Appl. No.: 250,343

[22] Filed: Sep. 28, 1988

[30] Foreign Application Priority Data

Oct. 2, 1987 [CH] Switzerland ..... 3865/87

[51] Int. Cl.[5] ..... B22C 9/12

[52] U.S. Cl. ..... 164/16; 164/159; 261/DIG. 65

[58] Field of Search ..... 164/12, 16, 159, 228; 261/141, 142, DIG. 65

[56] References Cited

U.S. PATENT DOCUMENTS 4,051,886 10/1977 Ross ..... 164/16
4,064,926 12/1977 Naegele ..... 164/12
4,312,397 1/1982 Harris et al. ..... 164/16
4,362,204 12/1982 Moore et al. ..... 164/16
4,483,384 11/1984 Michel ..... 164/16
4,540,531 9/1985 Moy ..... 164/16

*Primary Examiner*—Richard K. Seidel

[57] ABSTRACT

In the process and apparatus for making molds and cores, a casing for producing molds or cores is filled with a mixture of foundry sand and a binder. The mixture is hardened by a reagent which is firstly evaporated and introduced into the casing from a cylindrical container with a carrier gas or air flow supplied from a pressure gas source. The reagent is fed into the container by a dosing pump. A vacuum, or pressure below atmospheric pressure is produced in the container by a vacuum pump. The vacuum leads to the reagent evaporating more quickly than at atmospheric pressure. It is consequently possible to use reagents with a high boiling point, so that the hardening of the molds and cores is obtained less expensively and with reduced odorous annoyance.

11 Claims, 1 Drawing Sheet

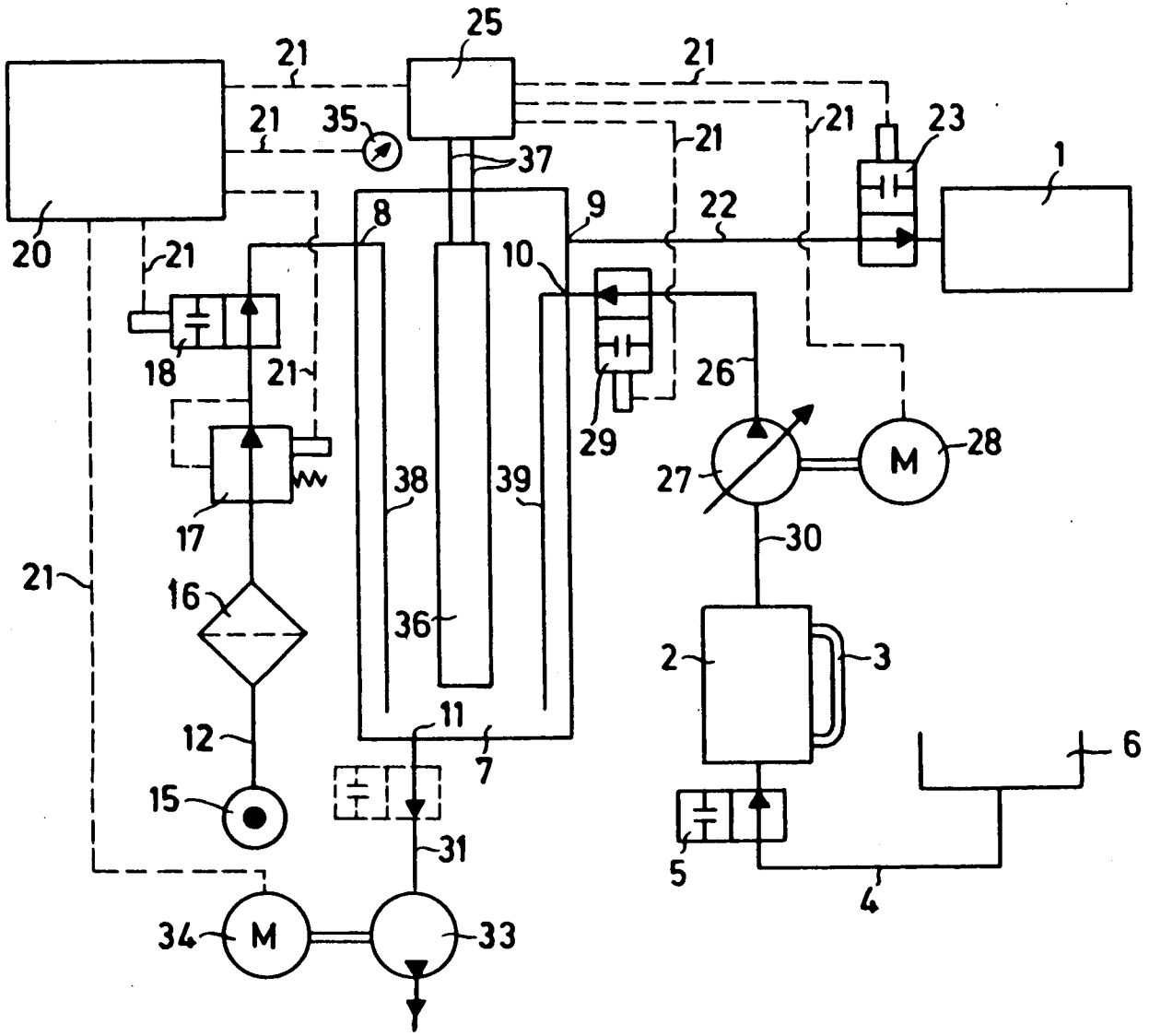
1
2
3
4
5
6
7
8
9
10
11
12
15
16
17
18
20
21
22
23
25
26
27
28
29
30
31
33
34
35
36
37
38
39
M
M

PROCESS FOR PRODUCING FOUNDRY MOLDS AND CORES FROM SAND AND A BINDER

BACKGROUND OF THE INVENTION

The present invention relates to a process for the production of foundry molds and cores from foundry sand mixed with a binder, in which process a reagent is supplied with the aid of a carrier airflow to the sand mixed with a binder located in a casing, and as a result of which the sand is hardened to form a dimensionally stable or rigid mold or core.

Processes for the production of foundry molds and cores according to the so-called box process are known in numerous different forms. The process essentially comprises mixing the foundry sand with a binder. The thus prepared sand is introduced into a casing constructed as the mold or core. A reagent, e.g. a catalyst in a carrier airflow is then introduced into the casing, so that a reaction takes place between the binder and the reagent, through which the mold is transformed into a dimensionally stable or rigid body. The reagents can be constituted e.g. by catalysts in the form of amines of different types.

In time the process has undergone various improvements and in particular the preheating of the reagent and the carrier air has led to a speeding up of the production of molds and cores. The normally liquid reagent must be converted into a gaseous state, so that there is a uniform hardening of the sand at all points. This is in particular achieved by heating the carrier air and the reagent.

A particular disadvantage of this process is that through the use of amines as reagents it is not possible to avoid considerable odorous annoyance for personnel working in such installations. These amines have different boiling points and correspondingly the odor formation differs. The higher the boiling point of the amine, the lower the odorous annoyance. However, it is disadvantageous in the case of such amines with a higher boiling point that the evaporation does no take place sufficiently rapidly, so that its distribution in the sand can vary, so that the mold or core has a lower quality.

SUMMARY OF THE INVENTION

It is an object of the present invention to provide an improved process for the production of foundry molds and cores of the aforementioned type in which high-boiling amines or other high-boiling reagents are employed and in spite of this it is possible to achieve a uniform hardening of the sand mold or core with considerably reduced odorous annoyance.

According to the invention this and other objects are attained by a process wherein the reagent is introduced into a vacuum zone or into an evacuated container where evaporation takes place and immediately thereafter the reagent is introduced by an air flow into the casing containing the foundry sand and a binder. Preferably, the reagent is introduced into a heated vacuum zone or a heated container. As a result of the vacuum formation and simultaneous heating of the reagent and carrier air, which can also be a carrier gas, e.g. carbon dioxide $CO_2$ or nitrogen $N_2$, the evaporation of the reagent is accelerated or it is possible to use a reagent with a correspondingly higher boiling point.

In the case of a successive production of the casting molds and cores, appropriately the vacuum zone is constructed as a closed area, which is evacuated prior to the introduction of the reagent and which is subsequently brought to overpressure by compressed air or gas. Retrograde condensation of the reagent is reliably avoided because the transition from a vacuum below atmospheric pressure to a corresponding overpressure takes place rapidly and the action on the casing also only takes a very short time.

The invention also covers an apparatus for performing the inventive process in an optimum manner.

According the invention an apparatus is provided, in which a container, equipped with a heating rod and with a supply line and a discharge line for the compressed air or a compressed gas, respectively, and a feed line for the supply of the reagent, has a connection for a vacuum pump which can be switched on and off.

In an embodiment, the container is appropriately constructed as a standing cylinder with a length forming a multiple of the container diameter, the opening of the feed line for the reagent being located in the vicinity of the container bottom.

The aforementioned objects, features and advantages of the invention will, in part, become obvious from the following more detailed description of the invention, taken in conjunction with the accompanying drawing, which form an integral part thereof.

BRIEF DESCRIPTION OF THE DRAWING

A single FIGURE of the drawing shows a diagram of an apparatus for producing foundry molds or cores according to the invention.

DETAILED DESCRIPTION OF THE PREFERRED EMBODIMENTS

In the drawing, reference numeral 1 denotes a casing, in which a foundry mold or core is produced by hardening foundry sand introduced into the casing and which is mixed therein with a binder. For this purpose use is made of a reagent, e.g. in the form of a liquid amine, a given quantity thereof being made available in a reagent container 2. The container 2 contains a liquid amine quantity covering the daily requirement. The supply in container 2 is monitored by a level measuring device 3, which is diagrammatically represented as a stand pipe, but other suitable conventional level measuring devices can also be used. The reagent container 2 has a feed line 4, which can be opened and closed by a 2/2 valve 5 (with two operating positions and two connections). The reagent can be transferred from a reserve container 6 into reagent container 2 by the feed line 4.

An important part of the plant shown in the drawing is constituted by an upright, cylindrical container 7, which has a plurality of line connections 8 to 11. At connection 8, a compressed air or gas supply line 12 ends. To the start of line 12 is connected a pressure source 15. Feed or supply line 12 successively contains an oil separator 16, a pressure regulating valve 17 and a 2/2 valve 18 (with two operating positions and two connections). The pressure regulating valve 17 is used for adjusting or varying a feed pressure of air or gas supplied to cylindrical container 7. The pressure regulating valve 17 is controlled by a central, programmable processor 20, which is connected to the pressure regulating valve 17 by means of a control line **21*a* represented in broken line. The 2/2 valve 18 is also connected by a control line 21*b* to processor 20**.

To the line connection 9 is connected a connecting line 22, which is connected across a two-position-two connection valve 23 with the casing 1. Connecting line 22 can be a rigid or flexible line, which can also be heated. Valve 23 is connected via a control line 21*c* to a regulating device 25, which is in turn connected to processor 20 via a control line 21*d*.

A pressure line 26 of a dosing pump 27 issues into line connection 10. Dosing pump 27 which is driven by an electric motor 28 is connected by means of a control line 21*e* to a regulating device 25. Pressure line 26 also contains a two position-two connection valve 29, which is connected via a control line 21*f* to the regulating device 25.

Dosing pump 27, which can e.g. be a diaphragm pump, supplies a corresponding necessary reagent quantity in pressure line 26 to cylindrical container 2 and through which pump 27 sucks the reagent.

A suction line 31 of a vacuum pump 33, driven by an electric motor 34, is connected to the line connection 11. Motor 34 is connected by a control line 21*g* to processor 20. It is also possible to provide in suction line 31, as in the pressure line 26 of dosing pump 27, a 2/2 valve 50 (shown by broken line) controlled by processor 20. A pressure meter 35 is connected to the cylindrical container 7. Pressure meter 35 supplies control signals to processor 20 via a control line 21*h*.

The function of cylindrical container 7 is to heat the compressed air or gas supplied by the pressure source 15 and also to evaporate the reagent volume supplied by dosing pump 27. For this purpose within the cylindrical container 7 is installed a rod-like heating element 36, the flow-carrying lines 37 of which are connected to the regulating device 25 for controlling the supplied thermal energy. Cylindrical container 7 can be constructed in several different ways. In the interior of container 7 are arranged a plurality of heat exchanger tubes 38, 39, of which only one is shown in each case. The complete interior of cylinder 7 can also be filled with a matrix, e.g. aluminum for heat storing purposes.

The plant shown in the drawing operates in the following way. It is assumed that the cylindrical container 7 is at operating temperature and casing 1 filled with sand and a binder is connected to connecting line 22. During the preparation for attaching casing 1 to line 22, i.e. for filling said casing with sand and binder, the feed line 12 of pressure source 15 and the pressure line 26 of dosing pump 27, as well as connecting line 22 are closed, whilst the vacuum pump 33 is switched on and a lower pressure is produced in container 7. This pressure can be monitored and regulated by pressure meter 35. On reaching a desired vacuum, following the opening of valve 29, dosing pump 27 feeds a predetermined reagent quantity into container 7. As a result of the vacuum, on the one hand, and the elevated temperature (e.g. 80° to 1255° C.), on the other hand, a very rapid evaporation of the reagent takes place. Valve 18 of pressure line 12 is then opened and compressed air or gas flows into container 7, whose vacuum is changed in a short time into an overpressure. After opening valve 23, the evaporated reagent is fed through the compressed air or gas as a carrier gas into casing 1, so that the mold or core is hardened. Following the removal of the casing 1, the mold or core located therein must be removed and the casing is refilled with sand and binder. During this time the process is repeated, i.e. the vacuum pump 33 produces the desired vacuum in container 7. As soon as this vacuum is reached, the reagent is fed into the cylinder 7 and almost simultaneously the compressed air or gas is introduced into container 7. In this time a new casing 1 has been connected to line 22 and then a new hardening process takes place following the opening of valve 23 in line 22.

The advantage of the above-described plant is that through producing a vacuum in cylindrical container 7, the boiling point of the supplied amine can be considerably reduced, which makes it possible to use hitherto unusable amines, such as e.g. triethyl amine TEA with a boiling point of 88° C. However, the evaporation of said amine takes place with a lower energy expenditure and lower chemical costs than when using an amine with a boiling point, e.g. dimethylethyl amine DMEA with a boiling point of 36° C. in a known plant without the production of vacuum.

There has been disclosed heretofore the best embodiment of the invention presently contemplated. However, it is to be understood that various changes and modifications may be made thereto without departing from the spirit of the invention.

What is claimed is

1. A process for the production of foundry molds and cores from foundry sand mixed with a binder, comprising the steps of placing sand and a binder in a mold casing; providing a first container filled with a liquid reagent; providing a second container connected to said first container and to said casing; providing a compressed carrier gas source connected to said second container; providing means for producing vacuum connected to said second container; producing vacuum in said second container by switching on said vacuum producing means after closing connections of said compressed carrier gas source and said first container to said second container and, after reaching vacuum in said second container, opening a connection between said first container and said second container to introduce said liquid reagent into said second container whereby said liquid reagent is rapidly evaporated; opening a connection between said carrier gas source and said second container whereby said vacuum in said second container is quickly changed into an overpressure; and feeding the evaporated reagent through a compressed carrier gas into said casing which results in hardening of the sand in said casing to a dimensionally stable mold or core.

2. Process according to claim 1, wherein said carrier gas flow is air flow.

3. Process according to claim 1, wherein a vacuum zone is provided in said second container.

4. Process according to claim 3, wherein said vacuum zone of said container is heated.

5. Process according to claim 3, wherein in a case of a successive production of foundry molds and cores said vacuum zone is constructed as a closed area which, prior to the introduction of the reagent, is evacuated and is subsequently brought to an overpressure by said compressed carrier gas.

6. Process according to claim 5, wherein the reagent is heated in said vacuum zone to 70° to 130° C.

7. Process according to claim 5, wherein the reagent is introduced into the vacuum zone under a vacuum in an interval between the production of two foundry molds or cores.

8. Process according to claim 7, wherein an interior of said second container is heated before the reagent is introduced thereinto.

9. Process according to claim 8, wherein the reagent is heated in said second container to 70° to 130° C.

10. Process according to claim 7, wherein said carrier gas is selected from the group consisting of carbon dioxide $CO_2$ and nitrogen $N_2$.

11. Process according to claim 7, wherein the reagent is introduced into said second container without preheating.

* * * * *